US011185731B2

(12) United States Patent
Wang

(10) Patent No.: US 11,185,731 B2
(45) Date of Patent: Nov. 30, 2021

(54) KETTLEBELL

(71) Applicant: BETO ENGINEERING AND MARKETING CO., LTD., Taichung (TW)

(72) Inventor: Lopin Wang, Taichung (TW)

(73) Assignee: Beto Engineering and Marketing Co., Ltd., Taichung (TW)

( * ) Notice: Subject to any disclaimer, the term of this patent is extended or adjusted under 35 U.S.C. 154(b) by 137 days.

(21) Appl. No.: 16/685,107

(22) Filed: Nov. 15, 2019

(65) Prior Publication Data

US 2021/0023411 A1 Jan. 28, 2021

(30) Foreign Application Priority Data

Jul. 26, 2019 (TW) ..... 108126594

(51) Int. Cl.
*A63B 21/075* (2006.01)

(52) U.S. Cl.
CPC ..... *A63B 21/075* (2013.01)

(58) Field of Classification Search
None
See application file for complete search history.

(56) References Cited

U.S. PATENT DOCUMENTS 7,976,443 B2 * 7/2011 Krull ..... A63B 21/075 482/108
7,981,013 B2 * 7/2011 Krull ..... A63B 21/075 482/108
8,784,280 B2 * 7/2014 Krull ..... A63B 21/00069 482/93
10,099,083 B1 * 10/2018 Owusu ..... A63B 21/072
10,463,906 B2 * 11/2019 Owusu ..... A63B 21/4035
10,695,614 B2 * 6/2020 Owusu ..... A63B 24/0087
2005/0003931 A1 * 1/2005 Mills ..... A63B 21/0601 482/5
2010/0120589 A1 * 5/2010 Krull ..... A63B 21/075 482/93
2018/0117387 A1 5/2018 Wang
2019/0240526 A1 * 8/2019 Owusu ..... A63B 21/00065
2020/0114204 A1 * 4/2020 Owusu ..... A63B 21/075

FOREIGN PATENT DOCUMENTS

DE 102017113777 A1 4/2018
TW I598131 B 9/2017

OTHER PUBLICATIONS

Office Action issued to German counterpart application No. 102019217532.5 by the DPMA dated Jun. 17, 2020.

* cited by examiner

*Primary Examiner* — Joshua Lee
(74) *Attorney, Agent, or Firm* — Muncy, Geissler, Olds & Lowe, P.C.

(57) ABSTRACT

A kettlebell includes a base seat, a plurality of weight plates stacked on the base seat, and a lift seat separably disposed on the base seat. The base seat includes a base main body, an adjusting module mounted to the base main body for adjusting configuration of the lift seat and the weight plates, and a locking module mounted in the base main body. The locking module is operable to switch between a locking state in which the locking module engages the adjusting module such that the adjusting module is not operable, and an unlocking state in which the locking module disengages from the adjusting module such that the adjusting module is operable.

13 Claims, 13 Drawing Sheets

KETTLEBELL

CROSS-REFERENCE TO RELATED APPLICATION

This application claims priority of Taiwanese Invention Patent Application No. 108126594, filed on Jul. 26, 2019.

FIELD

The disclosure relates to a kettlebell, and more particularly to an adjustable kettlebell.

BACKGROUND

A conventional kettlebell disclosed in Taiwanese Patent No. 1598131 includes a main body that defines a retaining space therein, a plurality of weight plates that are able to be disposed in the retaining space, and an adjusting unit that is mounted to the main body. Each of the weight plates is formed with a central through groove. The adjusting unit includes an axial rod, a plurality of support pins mounted to the axial rod, and an operating lever pivotally connected to a top end of the axial rod. Each of the support pins corresponds in position to and is for supporting a corresponding one of the weight plates. A user is able to operate the operating lever to rotate the axial rod so as to rotate each of the support pins between a support position, where the support pin is partially aligned with the central through groove of the corresponding weight plate so that the support pin supports the corresponding weight plate when the main body is lifted, and a separate position, where the support pin is completely aligned with the central through groove of the corresponding weight plate so that the support pin passes through the through groove of the corresponding weight plate when the main body is lifted. As such, the weight of the conventional kettlebell is adjustable (the number of the weight plates which move along with the main body is adjustable).

However, in use of the conventional kettlebell, the adjusting unit may be unintentionally operated so that the support pin(s) is moved to the separate position to thereby cause separation of the weight plate(s) from the main body.

SUMMARY

Therefore, an object of the disclosure is to provide a kettlebell that can alleviate the drawback of the prior art.

According to the disclosure, the kettlebell includes a base seat, a plurality of weight plates and a lift seat. The base seat includes a base main body, an adjusting module that is mounted to the base main body, and a locking module that is mounted in the base main body. The locking module is operable to switch between a locking state in which the locking module engages the adjusting module such that the adjusting module is not operable, and an unlocking state in which the locking module disengages from the adjusting module such that the adjusting module is operable. The weight plates are stacked one above another on the base main body. Each of the weight plates has a rod hole formed through top and bottom surfaces thereof. The lift seat is removably disposed on the base main body so as to switch the locking module from the locking state to the unlocking state. The lift seat includes a coupling module that is separably coupled to the adjusting module. The coupling module includes a plurality of support pins that respectively correspond in position to the weight plates. The coupling module is able to be driven by the adjusting module to rotate each of the support pins between a separate position, where the support pin is aligned with the rod hole of the corresponding weight plate so that the support pin passes through the rod hole of the corresponding weight plate when the lift seat is lifted, and a support position, where the support pin is misaligned from the rod hole of the corresponding weight plate so that the support pin supports the corresponding weight plate when the lift seat is lifted.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
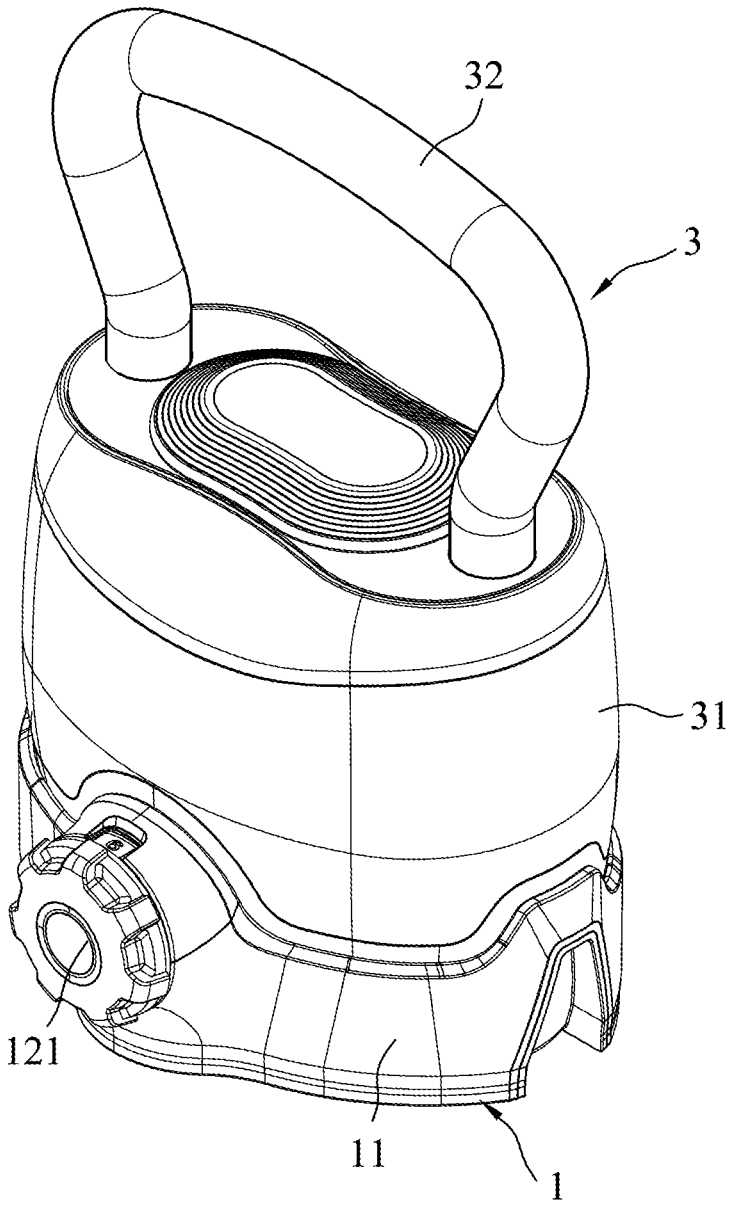
FIG. 1 is a perspective view illustrating an embodiment of the kettlebell according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
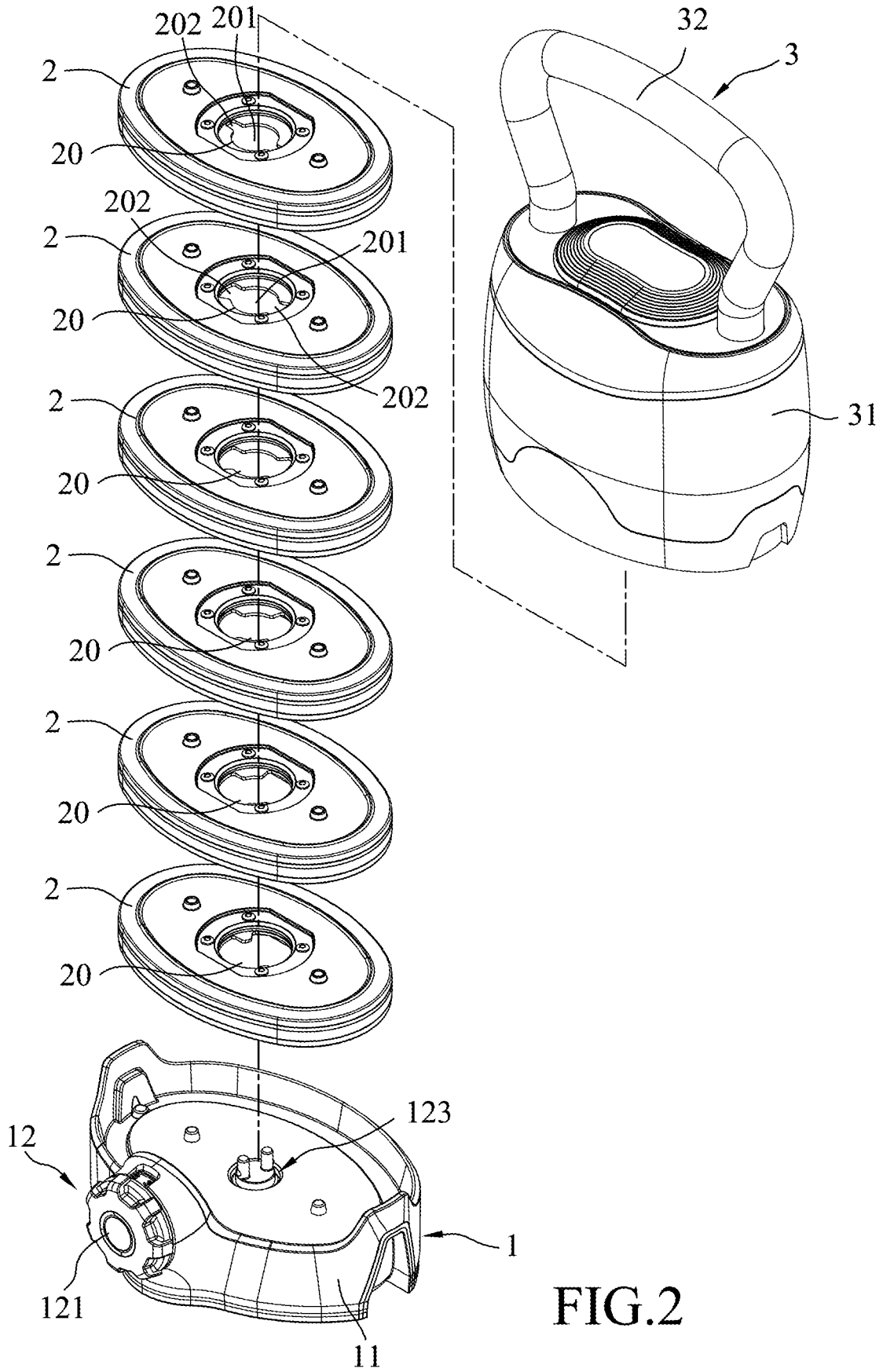
FIG. 2 is a partly exploded perspective view of the embodiment.
Figure 3:
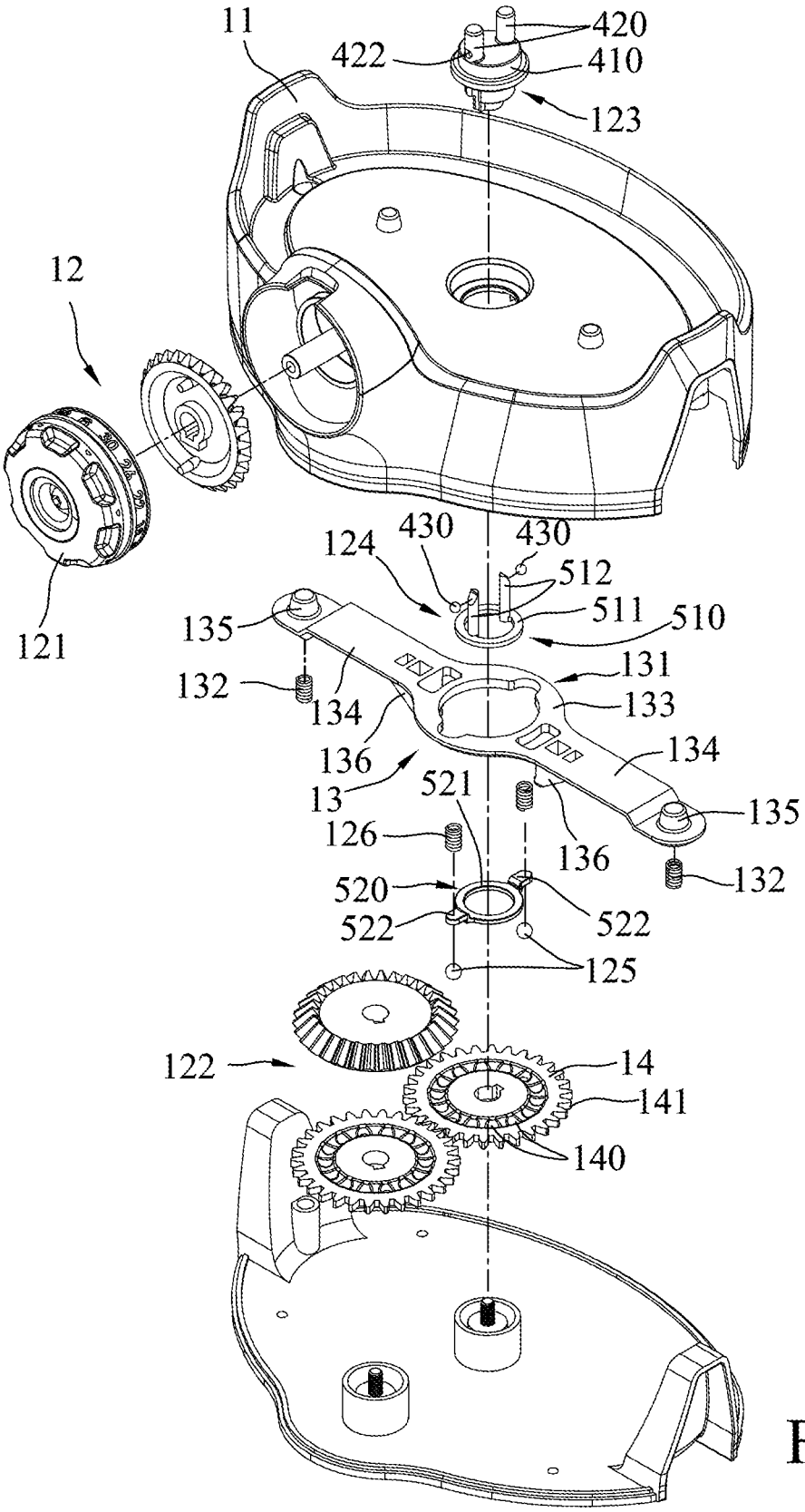
FIG. 3 is an exploded perspective view illustrating a base seat of the embodiment.

Referring to FIGS. 1 to 3, the first embodiment of the kettlebell according to the disclosure includes a base seat 1, six weight plates 2 and a lift seat 3.

The base seat 1 includes a base main body 11 defining a retaining space therein, an adjusting module 12 mounted to the base main body 11, and a locking module 13 mounted in the base main body 11. The adjusting module 12 includes a rotary button 121 that is rotatably mounted to an outer surface of the base main body 11, a drive mechanism 123 that is mounted to the base main body 11, a transmission gear train 122 that is connected between the rotary button 121 and the drive mechanism 123, a retention mechanism 124 that is disposed between the drive mechanism 123 and the transmission gear train 122, two retention balls 125 that are disposed between the retention mechanism 124 and the transmission gear train 122, and two retention resilient members 126 that are disposed between the retention mechanism 124 and the base main body 11. The rotary button 121 has a plurality of weight indication marks thereon.

The transmission gear train 122 includes a drive gear 14 that is connected to the drive mechanism 123, and a plurality of transmission gears connected between the drive gear 14 and the rotary button 121, such that rotation of the rotary button 121 relative to the base main body 11 drives rotation of the drive mechanism 123 relative to the base main body 11. The drive gear 14 has a plurality of retention grooves 140 formed in a top surface thereof and disposed about a rotating axis thereof. In one embodiment, the drive gear 14 is co-rotatably connected to the drive mechanism 123. The transmission gears may have various configurations, and are not limited to the configuration shown in FIG. 3.

Figure 4:
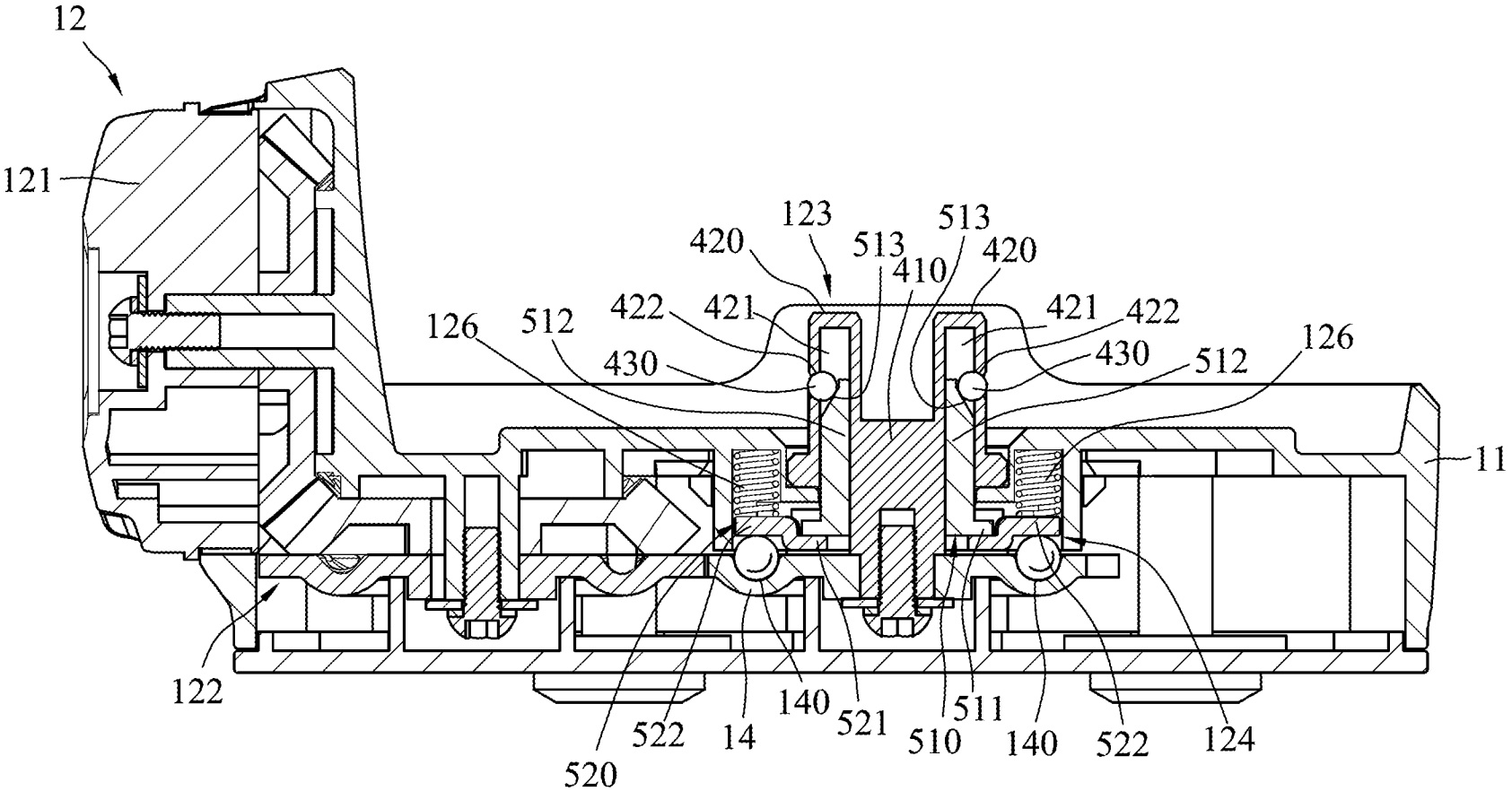
FIG. 4 is a sectional view illustrating the base seat.

Referring further to FIG. 4, the drive mechanism 123 includes a drive main portion 410 that is co-rotatably mounted to the drive gear 14, two drive post portions 420 that protrude from a top surface of the drive main portion 410, and two latch balls 430. Each of the drive post portions 420 is formed with a post groove 421 that opens downwardly, and a latch hole 422 that extends through a side wall of the drive post portion 420 in a radial direction and that is in spatial communication with the post groove 421. The latch balls 430 are respectively retained in the post grooves 421 of the drive post portions 420, and are operable to respectively and partially extend out of the latch holes 422 of the drive post portions 420.

The retention mechanism 124 includes a push member 510 that is mounted below the drive main portion 410 of the drive mechanism 123 and that is movable relative to the drive main portion 410 in an up-down direction, and a retention plate 520 that is disposed between the push member 510 and the drive gear 14. The push member 510 has a push main portion 511 that is sleeved on the drive main portion 410 of the drive mechanism 123 and that abuts against the retention plate 520, and two push post portions 512 that extend upwardly from the push main portion 511 and that are respectively inserted into the post grooves 421 of the drive post portions 420. Each of the push post portions 512 has an inclined surface 513 at a top end thereof that faces toward the latch hole 422 of the drive post portion 420 and that pushes against the respective one of the latch balls 430. The retention plate 520 has a retention main portion 521 that abuts against the push main portion 511 of the push member 510, and two lug portions 522 that extend away from each other from the retention main portion 521 in a radial direction of the retention plate 520.

The retention balls 125 are respectively and separably retained in two of the retention grooves 140 of the drive gear 14, and respectively abut against bottom portions of the lug portions 522 of the retention plate 520. Each of the retention resilient members 126 has two opposite ends respectively abutting against a top portion of a respective one of the lug portions 522 and the base main body 11, and resiliently pushes the respective one of the lug portions 522 downwardly. The retention balls 125, the retention resilient members 126 and the lug portions 522 of the retention plate 520 are configured to be permitted to move only in the up-down direction relative to the base main body 11 by a limiting structure (not shown), and not to move in a lateral direction relative to the base main body 11. The limiting structure may have various configurations.

Figure 5:
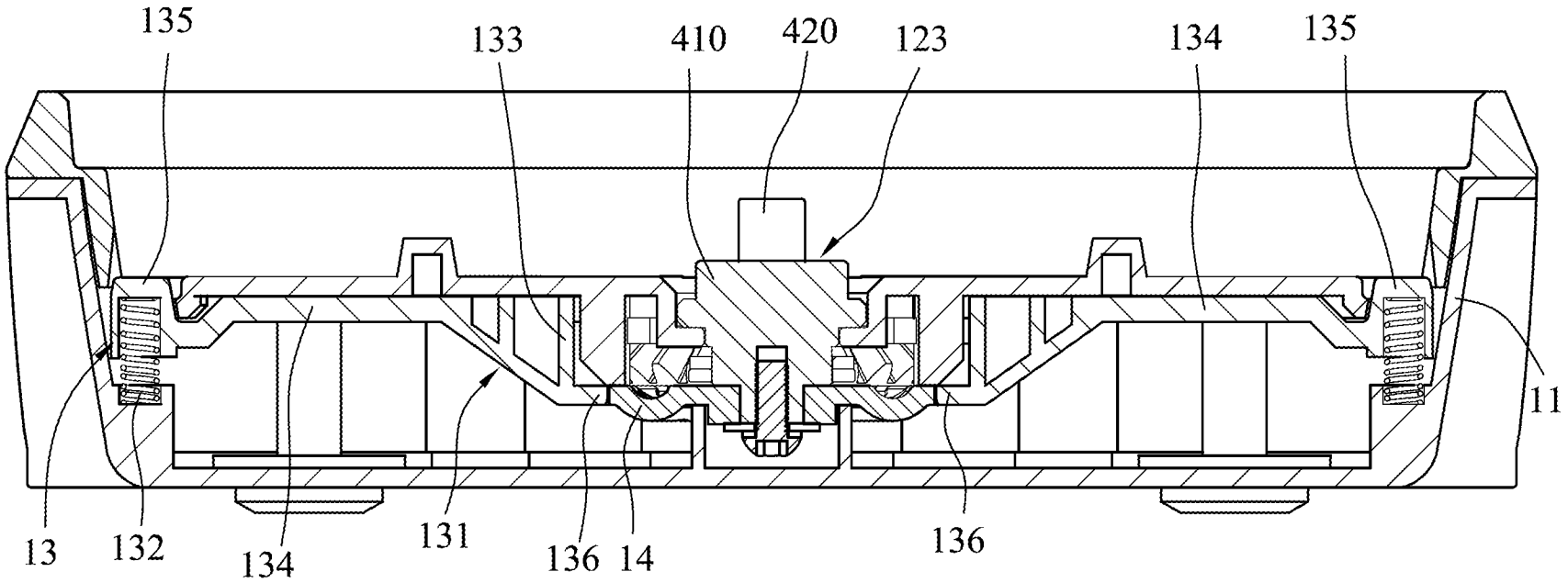
FIG. 5 is another sectional view illustrating the base seat.

Referring to FIGS. 3 and 5, the locking module 13 includes a locking plate 131 that is disposed in the base main body 11 and that partially protrudes out of the base main body 11, and two locking resilient members 132. The locking plate 131 has a central portion 133 permitting the adjusting module 12 to extend therethrough, two arm portions 134 extending away from each other from the central portion 133, two protrusions 135 each extending upwardly from a distal end of a respective one of the arm portions 134 and protruding out of the base main body 11, and two locking portions 136 respectively extending from bottom portions of the arm portions 134 and separably engaging teeth 141 of the drive gear 14. Each of the locking resilient members 132 has two opposite ends respectively abutting against a respective one of the protrusions 135 and the base main body 11.

Figure 13:
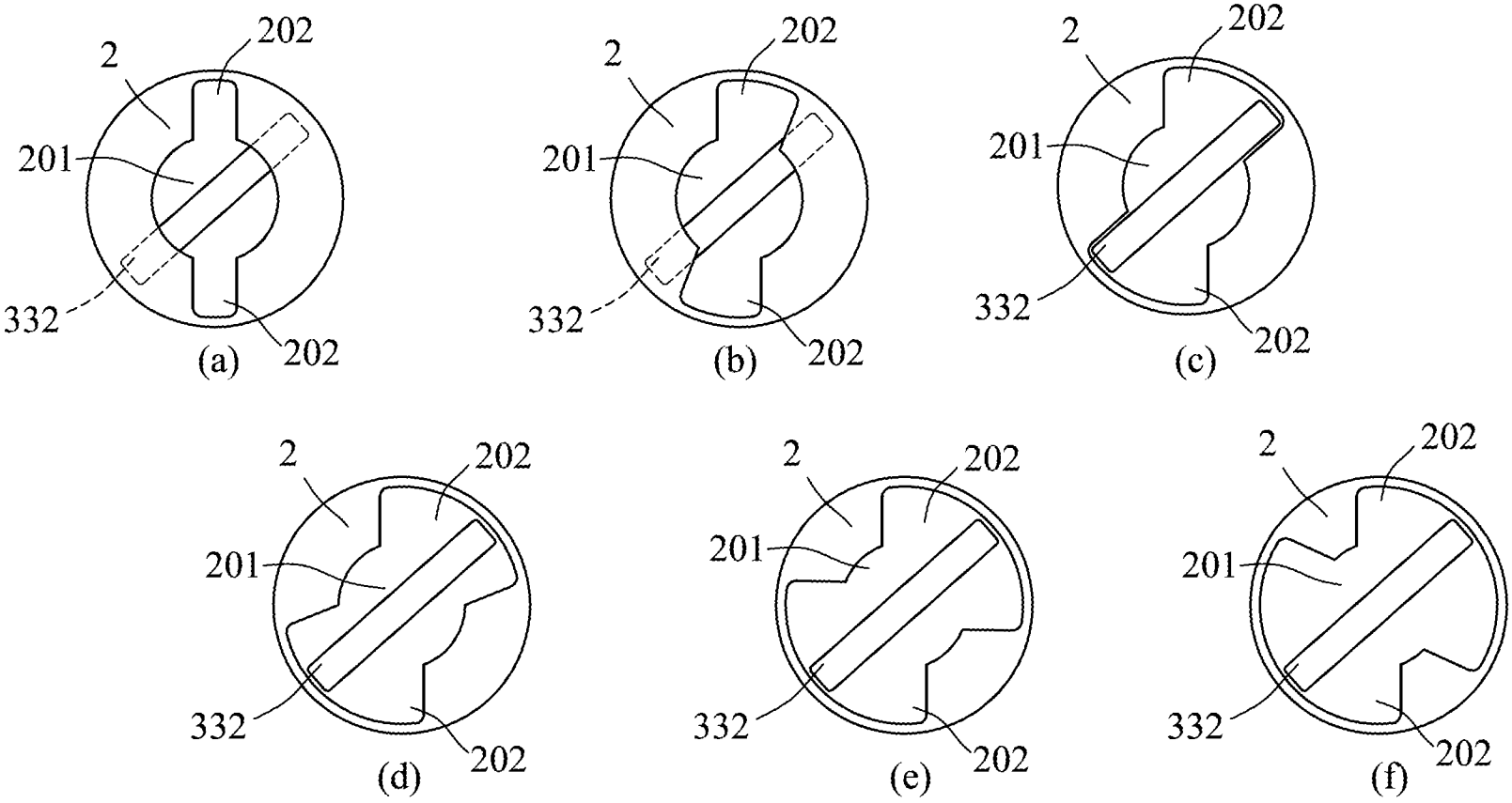

Referring to FIGS. 2 and 13, the weight plates 2 are stacked one above another on the base main body 11 of the base seat 1. Each of the weight plates 2 has a rod hole 20 formed through top and bottom surfaces thereof. The rod hole 20 of each of the weight plates 2 has a central portion 201, and two diametrically-opposite through groove portions 202 that are in spatial communication with the central portion 201. For any adjacent two of the weight plates 2, each of the through groove portions 202 of the lower one of the weight plates 2 has a width in a horizontal direction greater than that of each of the through groove portions 202 of the upper one of the weight plates 2. In other words, each of the through groove portions 202 of the lowermost weight plate 2 has a largest width, and each of the through groove portions 202 of the uppermost weight plate 2 has a smallest width.

Figure 6:
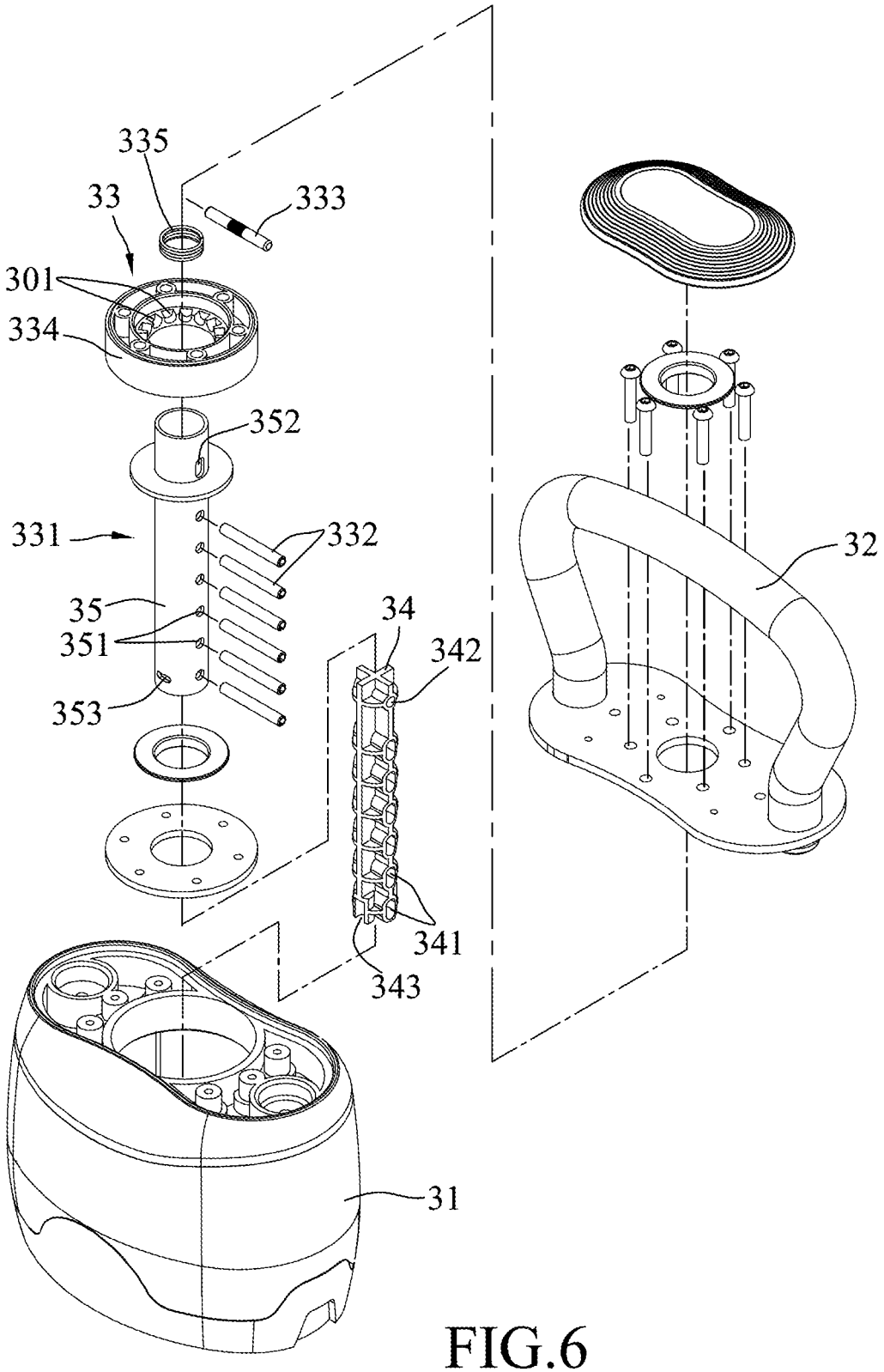
FIG. 6 is an exploded perspective view illustrating a lift seat of the embodiment.
Figure 11:
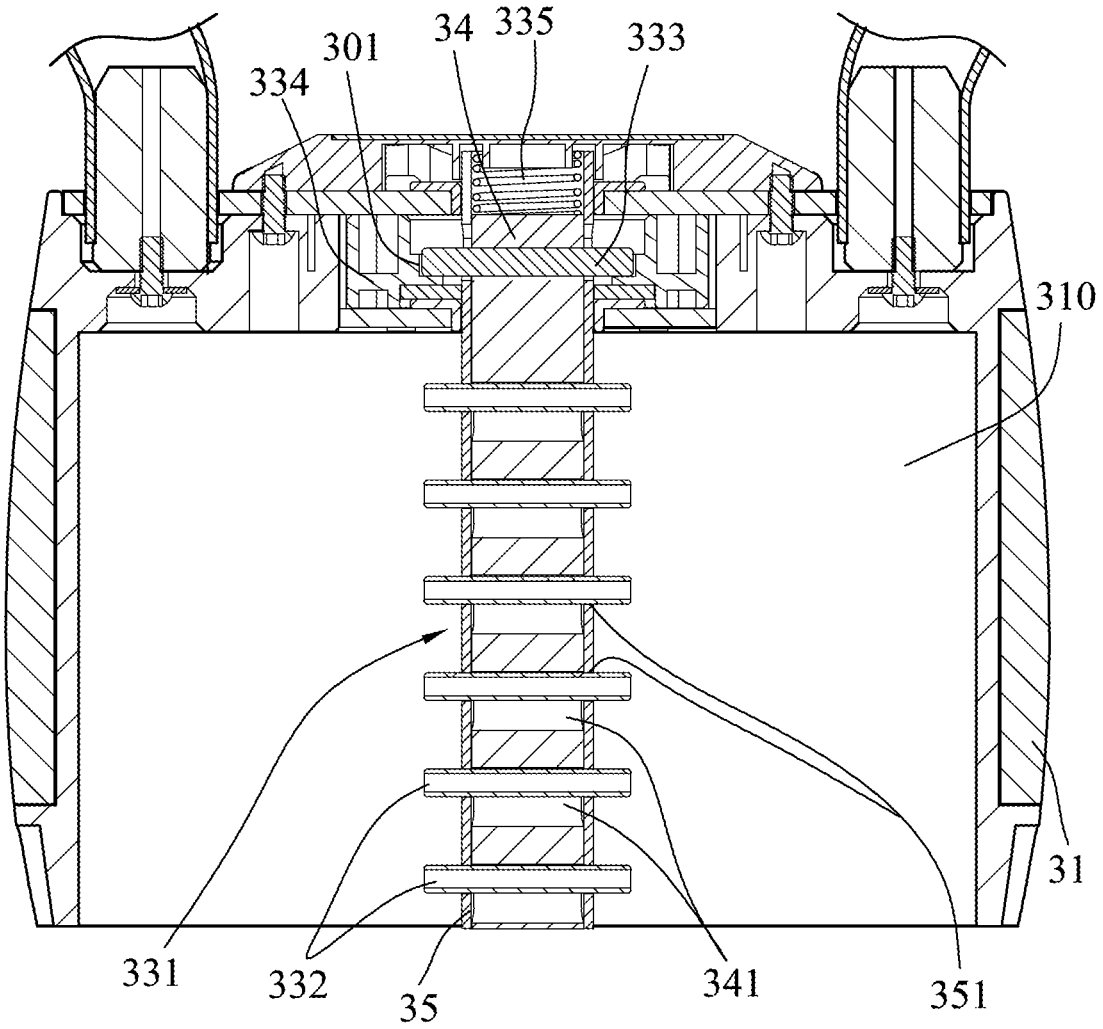
FIG. 11 is a fragmentary sectional view illustrating a positioning pin of the lift seat at an engaging position.

Referring to FIGS. 2, 6 and 11, the lift seat 3 includes a casing 31 that is separably disposed on the base main body 11 of the base seat 11, a handle 32 that is connected to the casing 31 and that is permitted to be gripped by a user, and a coupling module 33 that is disposed in the casing 31 and that is operable to be separably coupled to the drive mechanism 123. The casing 31 defines a retaining space 310 therein for the weight plates 2 to be disposed therein.

The coupling module 33 includes a rod unit 331, six support pins 332 that are mounted to the rod unit 331 in a diametric direction and that respectively correspond in position to the weight plates 2 for respectively supporting the weight plates 2, a positioning plate 334 that is fixedly mounted to the casing 31 and that permits the rod unit 331 to rotatably extend therethrough, a positioning pin 333 that is mounted to the rod unit 331 in the diametric direction and that separably engages the positioning plate 334, and a coupling resilient member 335 that has two opposite ends respectively abutting against a top end of the rod unit 331 and the casing 31.

The rod unit 331 is able to extend through the rod hole 20 of each of the weight plates 2, and includes a rod sleeve 35 that extends in the up-down direction, and a rod member 34 that extends through the rod sleeve 35 and that is movable relative to the rod sleeve 35 in the up-down direction. The rod member 34 has six elongated rod through grooves 341 that are spaced apart from each other in an axial direction of the rod member 34 and that extend in the axial direction, a circular rod through hole 342 that is formed in a diametric direction of the rod member 34 and that is located above the rod through grooves 341, and two drive grooves 343 (only one is shown in FIG. 6) that are separably engaged with the drive post portions 420 (see FIG. 3) of the drive mechanism 123. The rod sleeve 35 has six circular sleeve through holes 351 that are formed in a diametric direction of the rod sleeve 35 and that respectively correspond in position to the rod through grooves 341 of the rod member 34, a sleeve through groove 352 that extends in an axial direction of the rod sleeve 35 and that corresponds in position to the rod through hole 342 of the rod member 34, and two latch grooves 353 (only one is shown in FIG. 6) that are respectively in spatial communication with the drive grooves 343 of the rod member 34.

Each of the support pins 332 extends through a respective one of the rod through grooves 341 of the rod member 34 and a corresponding one of the sleeve through holes 351 of the rod sleeve 35 so as to be mounted to the rod unit 331, and has two opposite end portions extending out of the rod sleeve 35. When the rod unit 331 moves along the axial direction thereof relative to the weight plates 2, the end portions of each of the support pins 332 respectively pass through the through groove portions 202 of the rod hole 20 of the corresponding weight plate 2. Rotation of the rod unit 331 about the axial direction thereof relative to the weight plates 2 drives each of the support pins 332 to rotate between a separate position where the end portions of the support pin 332 are respectively aligned with the through groove portions 202 of the rod hole 20 of the corresponding weight plate 2 so that end portions of the support pin 332 pass through the through groove portions 202 of the rod hole 20 of the corresponding weight plate 2 when the lift seat 3 is lifted, and a support position where the end portions of the support pin 332 are misaligned from the through groove portions 202 of the rod hole 20 of the corresponding weight plate 2 so that the support pin 332 supports the corresponding weight plate 2 when the lift seat 3 is lifted. As such, the weight of the kettlebell is adjustable (the number of the weight plates 2 which move along with the lift seat 3 is adjustable).

The positioning pin 333 extends through the rod through hole 342 of the rod member 34 and the sleeve through groove 352 of the rod sleeve 35 so as to be mounted to the rod unit 331. The positioning plate 334 has a plurality of positioning grooves 301 that are formed in a top surface of the positioning plate 334 and that are disposed about the rod sleeve 35. The positioning pin 333 is operable to engages a selected pair of the positioning grooves 301 that are diametrically opposite to each other. In one embodiment, the positioning pin 333 is operable to engages a selected one of the positioning grooves 301.

Figure 7:
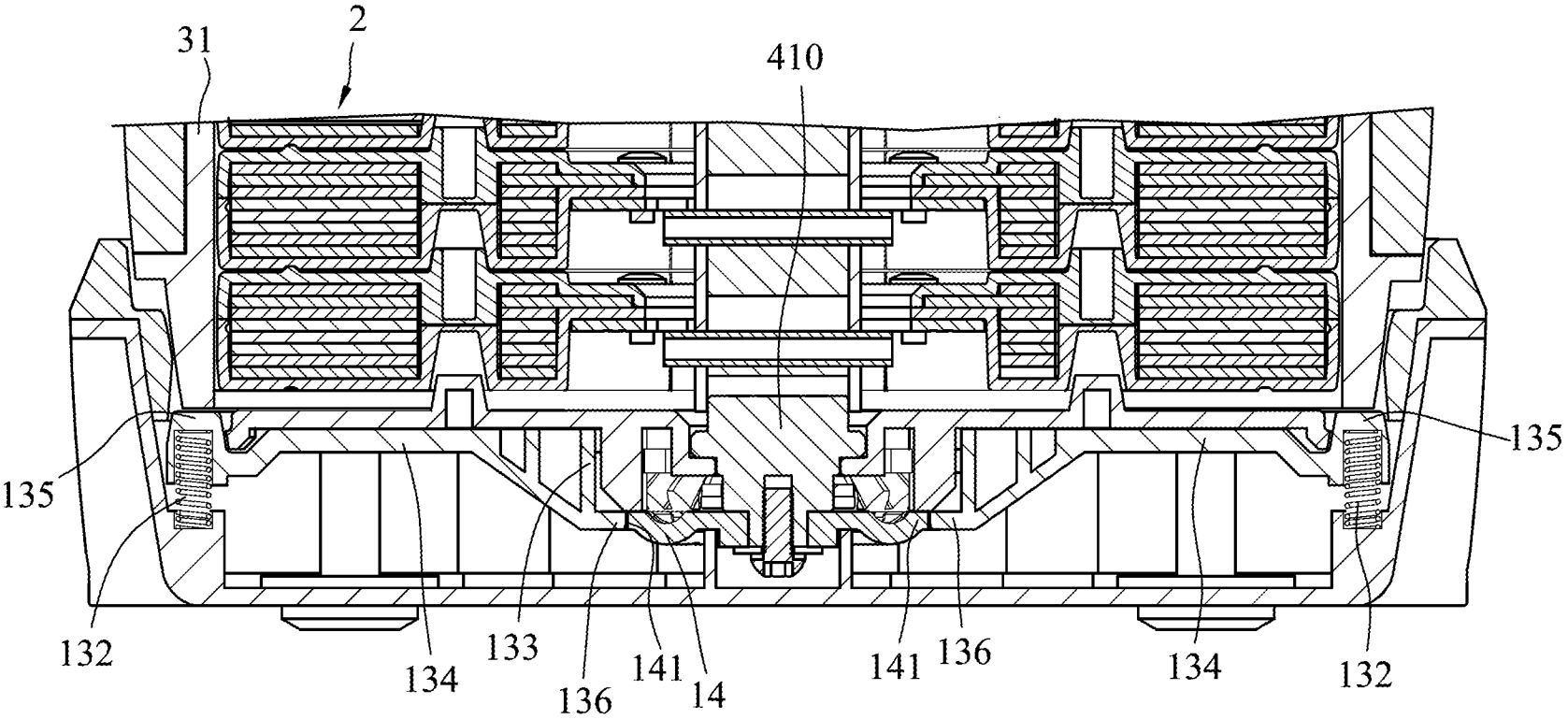
FIG. 7 is a fragmentary sectional view illustrating a locking module of the base seat in a locking state.
Figure 8:
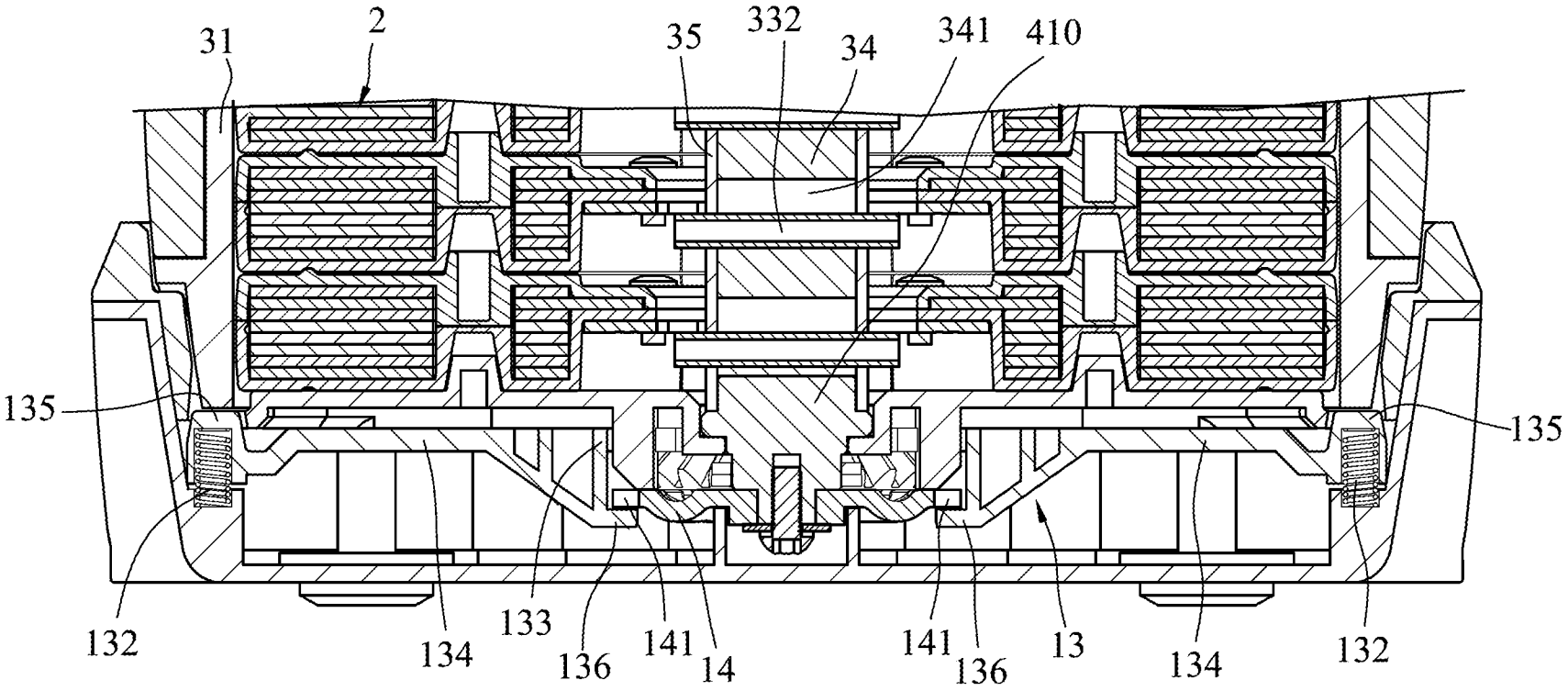
FIG. 8 is a fragmentary sectional view illustrating the locking module in an unlocking state.

Referring to FIGS. 7 and 8, the locking module 13 is operable to switch between a locking state (see FIG. 7) and an unlocking state (see FIG. 8). When the locking module 13 is in the locking state (the lift seat 3 is separated from the base seat 1), the protrusions 135 of the locking plate 131 are respectively biased by the locking resilient members 132 to extend out of an upper surface of the base main body 11 of the base seat 1, and the locking portions 136 engage the teeth 140 of the drive gear 14 so that the drive gear 14 cannot rotate relative to the base main body 11 (the rotary button 121 and the drive mechanism 123 cannot be operated to rotate relative to the base main body 11). When the lift seat 3 is placed onto the base seat 1, the casing 31 depresses the protrusions 135 of the locking plate 131 so as to switch the locking module 13 from the locking state to the unlocking state. At this time, the protrusions 135 retract into the base main body 11, and the locking portions 136 are disengaged from the teeth 140 of the drive gear 14 so that the drive gear 14 is rotatable relative to the base main body 11 (the rotary button 121 is operable to rotate the drive mechanism 123 relative to the base main body 11). At the same time the locking resilient members 132 are respectively compressed by the protrusions 135 to generate a restoring force for switching the locking module 13 back to the locking state when the lift seat 3 is separated from the base seat 1.

Figure 9:
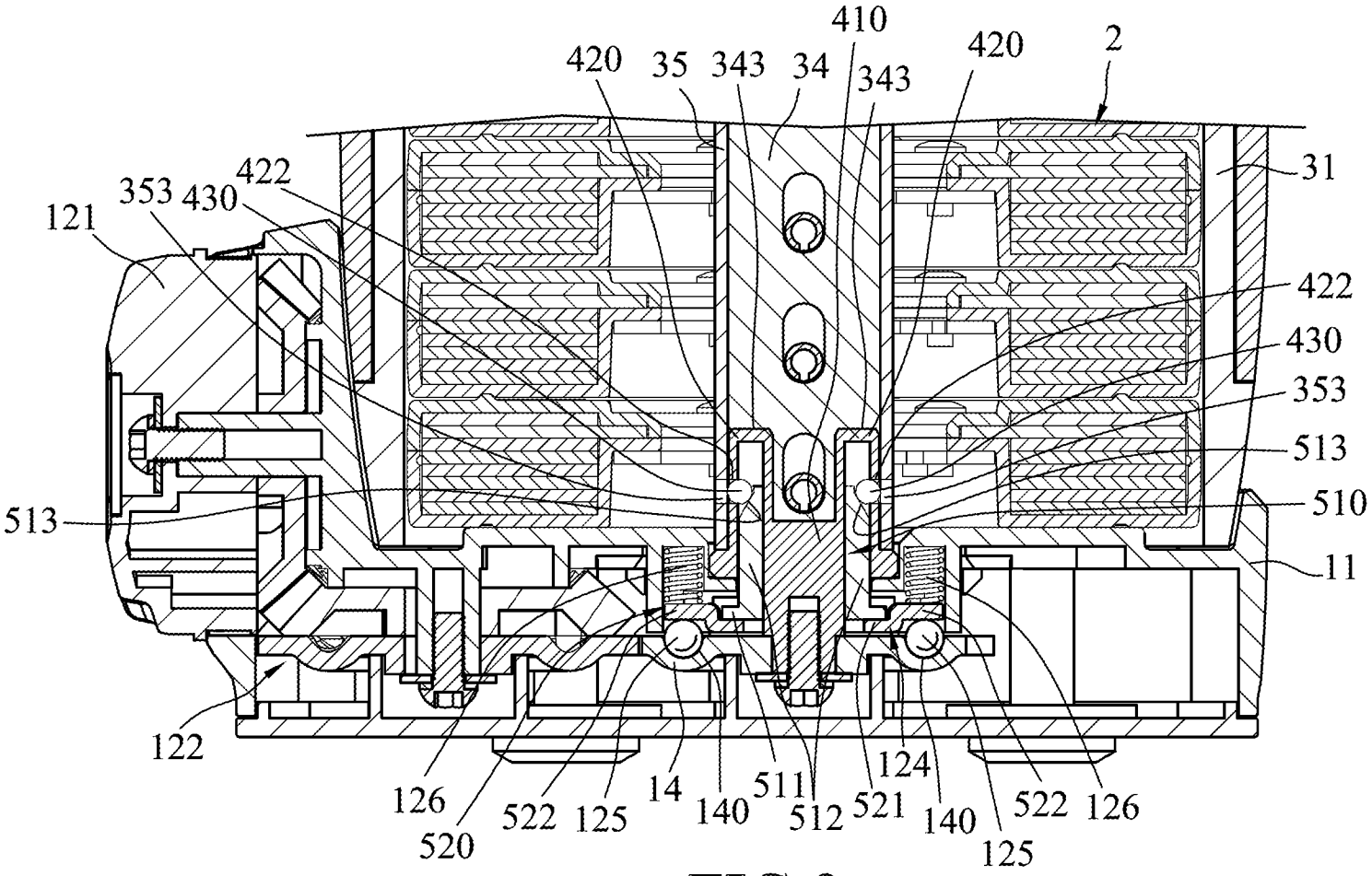
FIG. 9 is a fragmentary sectional view illustrating a retention mechanism of the base seat in a free state.
Figure 10:
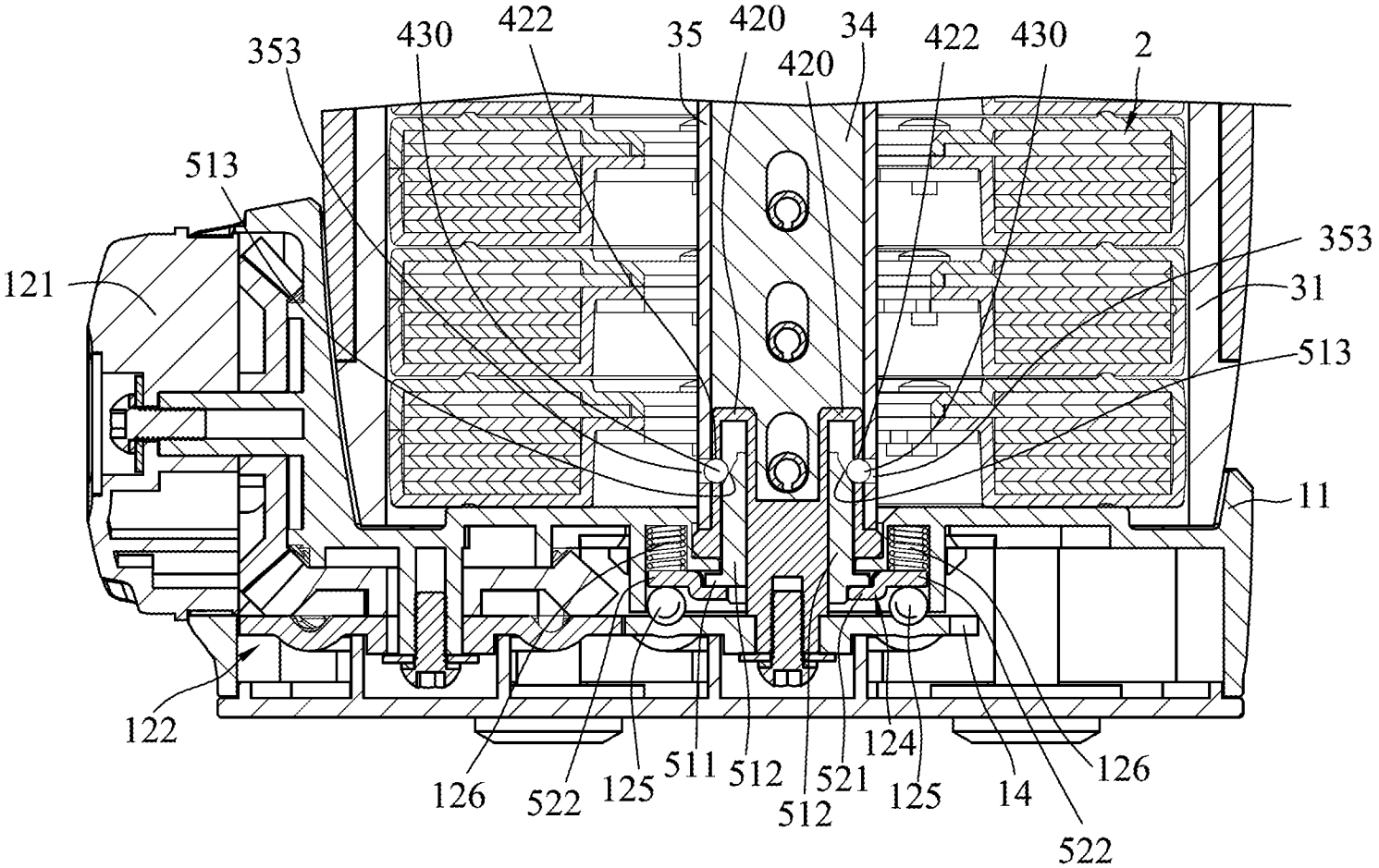
FIG. 10 is a fragmentary sectional view illustrating the retention mechanism in a retaining state.

Referring to FIGS. 3, 9 and 10, the retention mechanism 124 is operable to switch between a free state (see FIG. 9) and a retaining state (see FIG. 10). When the retention mechanism 124 is in the free state, the retention balls 125 are respectively retained in two of the retention grooves 140 of the drive gear 14, and the retention plate 520 is biased downwardly by the retention resilient members 126. At this time, the latch balls 430 respectively abut against the inclined surfaces 513 of the push post portions 512 of the push member 510, and are configured not to protrude out of the latch holes 422 of the drive post portions 420 of the drive mechanism 123, so as not to engage the latch grooves 353 of the rod sleeve 35. As such, the rod unit 331 can be freely separated from the drive mechanism 123.

When the rotary button 121 is operated to drive rotation of the drive gear 14, the retention balls 125 are pushed upwardly by partitions among the retention grooves 140 of the drive gear 14 to push the retention plate 520 upwardly against the biasing action of the retention resilient members 126 so as to switch the retention mechanism 124 to the retaining state. At this time, the retention plate 520 moves the push member 510 upwardly relative to the drive main portion 410, and the latch balls 430 are respectively pushed by the inclined surfaces 513 of the push post portions 512 of the push member 510 to protrude out of the latch holes 422 of the drive post portions 420 of the drive mechanism 123 so as to engage the latch grooves 353 of the rod sleeve 35. As such, the rod unit 331 cannot be separated from the drive mechanism 123. With further rotation of the drive gear 14, the retention balls 125 are configured to engage two of the retention grooves 140 of the drive gear 14 again, and the retention plate 520 is biased by the retention resilient members 126 to switch the retention mechanism 124 back to the free state.

Figure 12:
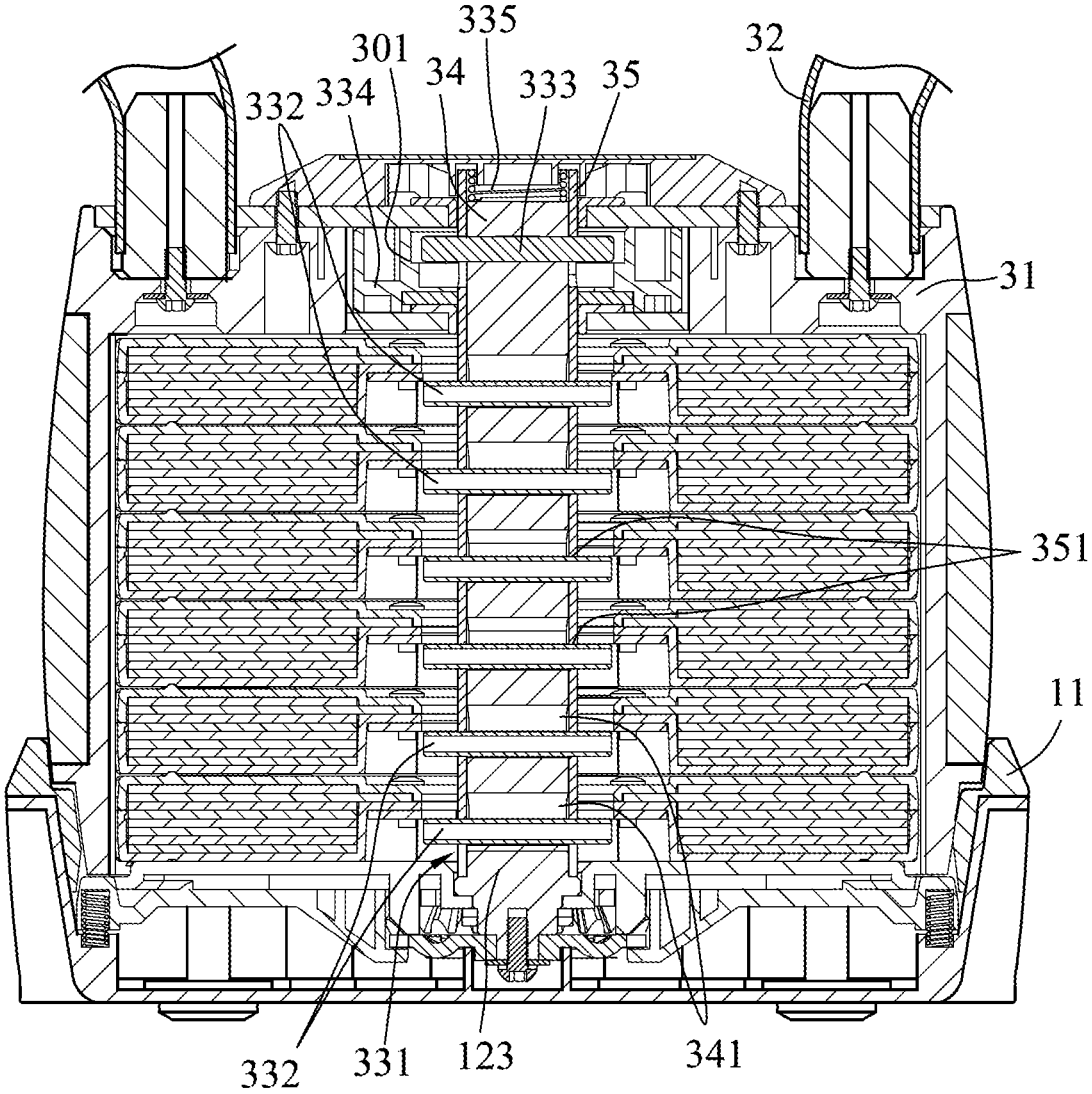
FIG. 12 is a fragmentary sectional view illustrating the positioning pin at a disengaging position; and Parts (a) to (f) of FIG. 13 are schematic views illustrating relative positions among weight plates and support pins of the embodiment.

Referring to FIGS. 6, 11 and 12, the positioning pin 333 can be driven by the rod member 34 to move relative to the positioning plate 334 between an engaging position (see FIG. 11) and a disengaging position (see FIG. 12). When the positioning pin 333 is at the engaging position, two opposite end portions of the positioning pin 333 respectively engage two of the positioning grooves 301 of the positioning plate 334 so that the rod unit 331 cannot rotate relative to the casing 31.

When the lift seat 3 is placed on the base seat 1 so that the rod unit 331 is coupled to the drive mechanism 123, the rod member 34 is pushed by the drive mechanism 123 to move upwardly relative to the rod sleeve 35, so as to move the positioning pin 333 upwardly relative to the positioning plate 334 to the disengaging position where the opposite end portions of the positioning pin 333 are respectively disengaged from the positioning grooves 301 of the positioning plate 334. At this time, the rod unit 331 can be driven by the drive mechanism 123 to rotate relative to the casing 31, and the coupling resilient member 335 is compressed by the rod member 34 to generate a restoring force. When the lift seat 3 is lifted (i.e., is separated from the base seat 1), the coupling resilient member 335 biases the rod member 34 downwardly relative to the rod sleeve 35 to move the positioning pin 333 to engage two of the positioning grooves 301 of the positioning plate 334, so as to move the positioning pin 333 back to the engaging position.

Referring to FIGS. 2, 8 and 12, in use of the kettlebell of this disclosure, the weight plates 2 are stacked on the base seat 1 one above another, and the lift seat 3 is disposed on and coupled to the base seat 1 such that the locking module 13 is switched into the unlocking state and the positioning pin 333 is moved to the disengaging position. At this time, the user can rotate to rotary button 121 to obtain a desired configuration of the kettlebell. Rotation of the rotary button 121 drives rotation of the drive mechanism 123 and the rod unit 311 so as to move the support pins 332 between the separate position and the support position.

Referring further to FIG. 13, when it is desired to couple two of the weight plates 2 with the lift seat 3, the rotary button 121 is operated to rotate the support pins 332 to a specific angle such that the upper two of the support pins 322 are at the support position, as shown in parts (a) and (b) of FIG. 13, and the other four of the support pins are at the separate position, as shown in parts (c), (d), (e) and (f) of FIG. 13.

After the abovementioned adjustment, the upper two of the weight plates 2 move along with the lift seat 3 when the lift seat 3 is lifted. After the lift seat 3 is separated from the base seat 1, the positioning pin 333 is moved to the engaging position to prevent the rod unit 331 from rotating relative to the casing 31, so as to prevent the upper two of the weight plates 2 from being separated from the lift seat 3. The locking module 13 is switched into the locking state, so as to maintain the position of the rotary button 121.

To adjust the number of the weight plates 2 that are moved along with the lift seat 3, the lift seat 3 can be placed onto the base seat 1 again to switch the locking module to the unlocking state and to move the positioning pin 333 to the disengaging position for operation of the rotary button 121.

In summary, the user can operate the adjusting module 12 that is disposed on the base main body 11 to adjust the configuration of an assembly of the lift seat 3 and the weight plates 2, and separate the coupling module 33 from the adjusting module by lifting the lift seat 3. By virtue of the positioning pin 333, the weight plates 2 movable along with the lift seat 3 may not be separated from the lift seat 3 during exercise. By virtue of the retention mechanism 124, the rod unit 331 cannot be separated from the drive mechanism 123 before the support pins 332 are properly positioned. By virtue of the locking module 13, the adjusting module cannot be operated after the lift seat 3 is separated from the base seat 1, so as to permit the position of the rotary button 121 to properly correspond to the configuration of the assembly of the lift seat 3 and the weight plates 2 that is separated from the base seat 1.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A kettlebell comprising:

a base seat including a base main body, an adjusting module that is mounted to said base main body, and a locking module that is mounted in said base main body, said locking module being operable to switch between a locking state in which said locking module engages said adjusting module such that said adjusting module is not operable, and an unlocking state in which said locking module disengages from said adjusting module such that said adjusting module is operable;

a plurality of weight plates stacked one above another on said base main body, each of said weight plates having a rod hole formed through top and bottom surfaces thereof; and a lift seat removably disposed on said base main body so as to switch said locking module from the locking state to the unlocking state, said lift seat including a coupling module that is separably coupled to said adjusting module, said coupling module including a plurality of support pins that respectively correspond to said weight plates, said coupling module being able to be driven by said adjusting module to rotate each of said support pins between a separate position where each of said support pins is aligned with each said rod hole of said corresponding weight plate so that each of said support pins passes through each said rod hole of said corresponding weight plate when said lift seat is lifted, and a support position where each of said support pins is misaligned from each said rod hole of said corresponding weight plate so that each of said support pins supports said corresponding weight plate when said lift seat is lifted, wherein said locking module includes a locking plate that is disposed in said base main body and that partially protrudes out of said base main body, and at least one locking resilient member that has two opposite ends respectively abutting against said locking plate and said base main body, said locking plate being depressed downwardly by said lift seat so as to switch said locking module from the locking state to the unlocking state when said lift seat is placed on said base main body, said at least one locking resilient member resiliently biasing said locking plate upwardly for switching said locking module to the locking state.

2. The kettlebell as claimed in claim 1, wherein said locking plate has a central portion that permits said adjusting module to extend therethrough, at least one arm portion that extends from said central portion, at least one protrusion that corresponds in number to said at least one arm portion, that extends upwardly from a distal end of said at least one arm portion and that protrudes out of said base main body, and at least one locking portion that corresponds in number to said at least one arm portion, that extends from bottom portion of said at least one arm portion and that separably engages said adjusting module, wherein when said locking module is switched from the locking state to the unlocking state, said at least one protrusion is depressed by said lift seat so as to drive said at least one locking portion to disengage said adjusting module.

3. The kettlebell as claimed in claim 2, wherein said locking plate has two of said arm portions that extend away from each other from said central portion, two of said protrusions each of which extends upwardly from a distal end of a respective one of said arm portions and that protrude out of said base main body, and two of said locking portions that respectively extend from said bottom portions of said arm portions.

4. The kettlebell as claimed in claim 1, wherein said adjusting module includes a rotary button that is rotatably mounted to said base main body, a drive mechanism that is mounted to said base main body and that is separably coupled to said coupling module, and a transmission gear train that is connected between said rotary button and said drive mechanism, wherein rotation of said rotary button relative to said base main body drives rotation of said drive mechanism relative to said base main body for driving rotation of said coupling module, wherein when said locking module is in the locking state, said locking plate engages said transmission gear train such that said rotary button cannot be operated.

5. The kettlebell as claimed in claim 4, wherein said transmission gear train includes a drive gear that is connected to said drive mechanism, and a plurality of transmission gears connected between said drive gear and said rotary button, said drive gear having a plurality of retention grooves that are formed in a top surface thereof and that are disposed about a rotating axis thereof, said adjusting module further including a retention mechanism that is disposed between said drive mechanism and said transmission gear train, and at least one retention ball that is separably retained in a selected one of said retention grooves of said drive gear, that abuts against a bottom portion of said retention mechanism and that is not to move in a lateral direction relative to said base main body, said retention mechanism being operable to switch between a free state in which said drive mechanism and said coupling module can be separated from each other, and a retaining state in which said drive mechanism and said coupling module cannot be separated from each other, wherein when said drive gear is rotated by said rotary button, said at least one retention ball is pushed upwardly by partitions among said retention grooves to push said retention mechanism upwardly so as to switch said retention mechanism to the retaining state.

6. The kettlebell as claimed in claim 5, wherein said coupling module includes at least one drive groove, and at least one latch groove that corresponds in number to said at least one drive groove and that is in spatial communication with said at least one drive groove, said drive mechanism including a drive main portion that is co-rotatably mounted to said drive gear, at least one drive post portion that corresponds in number to said at least one drive groove, that protrudes from a top surface of said drive main portion and that separably engages said at least one drive groove, and at least one latch ball that corresponds in number to said at least one drive groove, said at least one drive post portion being formed with a post groove that opens downwardly, and a latch hole that extends through a side wall of said at least one drive post portion in a radial direction and that is in spatial communication with said post groove and said latch groove, said at least one latch ball being retained in said post groove of said at least one drive post portion, said retention mechanism including a push member that is mounted below said drive main portion of said drive mechanism and that is movable relative to said drive main portion in an up-down direction, and a retention plate that is disposed between said push member and said drive gear and that has a bottom portion abutting against said at least one retention ball, said push member having at least one push post portion that corresponds in number to said post groove and that is inserted into said post groove, said at least one push post portion having an inclined surface at a top end thereof that faces toward said latch hole of said drive post portion and that pushes against said latch ball, wherein when said retention mechanism is in the retaining state, said at least one retention ball pushes said retention plate and said push member upwardly such that said inclined surface of said at least one push post portion pushes said at least one latch ball to partially extend out of said latch hole of said drive post portion to engage said latch groove.

7. The kettlebell as claimed in claim 6, wherein said retention plate has a retention main portion, and at least one lug portion that corresponds in number to said retention ball, that extends from said retention main portion in a radial direction of said retention plate and that has a bottom portion abutting against said at least one retention ball.

8. The kettlebell as claimed in claim 7, wherein said adjusting module further includes at least one retention resilient member that has two opposite ends respectively abutting against a top portion of said lug portion and said base main body, and that resiliently pushes said lug portion downwardly to push said retention ball.

9. The kettlebell as claimed in claim 8, wherein said adjusting module includes two of said retention balls and two of said retention resilient members, said retention plate having two of said lug portions that extend away from each other from said retention main portion and that respectively abut against said retention balls, said retention resilient members respectively biasing said lug portions to respectively push said retention balls to be retained in two of said retention grooves of said drive gear.

10. The kettlebell as claimed in claim 1, wherein said rod hole of each of said weight plates has a central portion that permits a rod unit of said coupling module to extend therethrough, and two diametrically-opposite through groove portions that are in spatial communication with said central portion and that permit said corresponding support pin to pass therethrough, wherein for any adjacent two of said weight plates, each of said through groove portions of the lower one of said weight plates has a width in a horizontal direction greater than that of each of said through groove portions of the upper one of said weight plates.

11. A kettlebell comprising:

a base seat including a base main body, an adjusting module that is mounted to said base main body, and a locking module that is mounted in said base main body, said locking module being operable to switch between a locking state in which said locking module engages said adjusting module such that said adjusting module is not operable, and an unlocking state in which said locking module disengages from said adjusting module such that said adjusting module is operable;

a plurality of weight plates stacked one above another on said base main body, each of said weight plates having a rod hole formed through top and bottom surfaces thereof; and a lift seat removably disposed on said base main body so as to switch said locking module from the locking state to the unlocking state, said lift seat including a coupling module that is separably coupled to said adjusting module, said coupling module including a plurality of support pins that respectively correspond to said weight plates, said coupling module being able to be driven by said adjusting module to rotate each of said support pins between a separate position where each of said support pins is aligned with each said rod hole of said corresponding weight plate so that each of said support pins passes through each said rod hole of said corresponding weight plate when said lift seat is lifted, and a support position where each of said support pins is misaligned from each said rod hole of said corresponding weight plate so that each of said support pins supports said corresponding weight plate when said lift seat is lifted;

wherein said lift seat includes a casing that permits said coupling module to be mounted thereto, said coupling module further including a rod unit that permits said support pins to be mounted thereto, a positioning plate that is fixedly mounted to said casing and that permits said rod unit to rotatably extend therethrough, and a positioning pin that is mounted to said rod unit in a diametric direction, said positioning plate having a plurality of positioning grooves that are formed in a top surface of said positioning plate and that are disposed about said rod unit, said positioning pin being able to be driven by said rod unit to move relative to said positioning plate between an engaging position where said positioning pin engages a selected one of said positioning grooves of said positioning plate so that said rod unit cannot rotate relative to said casing, and a disengaging position where said positioning pin disengages said positioning grooves of said positioning plate and is located above said positioning plate so that said rod unit is rotatable relative to said casing, said adjusting module pushing said rod unit to move said positioning pin to the disengaging position when said lift seat is placed on said base seat.

12. The kettlebell as claimed in claim 11, wherein said rod unit includes a rod sleeve that extends in an up-down direction, and a rod member that extends through said rod sleeve and that is movable relative to said rod sleeve in the up-down direction, said rod member having a plurality of elongated rod through grooves that are spaced apart from each other in an axial direction of said rod member and that extend in the axial direction, a circular rod through hole that is formed in a diametric direction of said rod member and that is located above said rod through grooves, and at least one drive groove that is separably engaged with said adjusting module, said rod sleeve having a plurality of circular sleeve through holes that respectively correspond in position to said rod through grooves of said rod member, and a sleeve through groove that extends in an axial direction of said rod sleeve and that corresponds in position to said rod through hole of said rod member, each of said support pins extending through a respective one of said rod through grooves of said rod member and a corresponding one of said sleeve through holes of said rod sleeve so as to be mounted to said rod unit, said positioning pin extending through said rod through hole of said rod member and said sleeve through groove of said rod sleeve so as to be mounted to said rod unit, said adjusting module pushing said rod member to move upwardly relative to said rod sleeve so as to move said positioning pin to the disengaging position when said lift seat is placed on said base seat.

13. The kettlebell as claimed in claim 12, wherein said coupling module further includes a coupling resilient member that has two opposite ends respectively abutting against a top end of said rod unit and said casing and that resiliently biases said positioning pin to the engaging position.

* * * * *